US006050386A

United States Patent [19]

Niizuma

[11] Patent Number: 6,050,386

[45] Date of Patent: Apr. 18, 2000

[54] INSPECTION METHOD IN A BILL PROCESSING MACHINE

[75] Inventor: Nobuyuki Niizuma, Nagano, Japan

[73] Assignee: Fuji Electric Co., Ltd., Kawasaki, Japan

[21] Appl. No.: 09/158,113

[22] Filed: Sep. 22, 1998

[30] Foreign Application Priority Data

Sep. 25, 1997 [JP] Japan ..... 9-260657

[51] Int. Cl.[7] ..... G07D 7/00

[52] U.S. Cl. ..... 194/206; 235/379

[58] Field of Search ..... 194/206, 207, 194/210, 213; 209/534; 235/379

[56] References Cited

U.S. PATENT DOCUMENTS 5,247,159 9/1993 Yuge et al. ..... 235/379

5,907,141 5/1999 Deaville et al. ..... 194/207 X

*Primary Examiner*—F. J. Bartuska

*Attorney, Agent, or Firm*—Kanesaka & Takeuchi

[57] ABSTRACT

In a method of the invention, a balance in a bill processing machine can be easily inspected and identified. At first, an input bill identification section of the bill processing machine identifies whether an imitation bill created for inspection is being input. If the imitation bill is detected, inspection counters for bill types are cleared, and sequentially, bills loaded and stored in a bill storage is circulated via a circulating path in the bill processing machine. The bills delivered from the bill storage in the circulation operation are identified, and a number of bills according to the bill types is counted at inspection counters. When the imitation bill sent to the bill storage is identified by an output-bill identification section in the circulation operation, the circulating operation is stopped, and the imitation bill is discharged from the bill processing machine.

5 Claims, 6 Drawing Sheets

INSPECTION METHOD IN A BILL PROCESSING MACHINE

BACKGROUND OF THE INVENTION AND RELATED ART STATEMENT

The present invention relates to an inspection method in a bill processing machine or change paying machine, which may be used at a counter in a supermarket or a convenience store to store received bills and to reuse the stored bills as a change, wherein the method is used when the balance in the bill processing machine is checked, such as in changing a register operator.

In recent years, a bill processing machine or change paying machine in, such as a POS (point of sales) system, connected to a higher level apparatus to enable received bills to be reused as a change has been introduced into supermarkets and convenience stores together with coin processing machines.

Generally speaking, the bill processing machine has a mechanical function that picks up input bills, stores the bills in a bill storage, transmits input-bill information to an external higher apparatus, and also, in response to a change payment request from the external higher apparatus, transmits input-bill information for the stored bills and pays a corresponding amount of money as a change.

A main object of the introduction of such a bill or coin processing machines is to automate the payment and storage of money in order to reduce the burden on a register operator associated with the handling of cash in order to increase the efficiency of accurate calculation operations while eliminating errors in calculations.

In the conventional bill processing machine, to manage cash appropriately, an input port for the machine must be used to fill or set reserved bills for changes in the machine. This is because by inputting bills from the input port, the type and number of the bills and thus the balance in the bill processing machine can be determined to enable cash to be managed precisely.

In such a bill processing machine, however, the number of bills that can be input to the input port at a time is physically limited, so that the bills must be divided into a certain number of groups for input, thereby requiring a considerable amount of time to fill or store reserved bills. Thus, despite an instruction to use the input port to refill the reserved bills for changes, in order to reduce the time required to set the reserved bills in the bill storage, the bill processing machine may be opened to set the reserved bills directly in the bill storage. In addition, the bills stored in the bill storage may be "handled" directly to change the bills into a different type.

If reserved bills are set directly in the bill storage of the bill processing machine, there will be a difference between the theoretical balance for the type of money known by the bill processing machine and the cash actually stored in the machine. If, however, several persons take turns to operate the same register, the problem is when and by whom that error was caused, creating tense and undesirable personal relations. In order to clarify each operator's duty and responsibility, the theoretical balance and cash actually stored must be checked whenever a register operator is changed.

This invention is provided in view of these problems, and its object is to provide an inspection method in a bill processing machine, wherein bills stored in a bill storage is precisely inspected before a register operator is changed in order to simplify the handling of money and to clarify each operator's responsibility.

SUMMARY OF THE INVENTION

To achieve the object, this invention provides an inspection method in a bill processing machine, which comprises an input-bill identification section for identifying input bills; a bill storage for receiving the identified bills through a reception port, storing the bills therein, and delivering the stored bills from a delivery port; an output-bill identification section for identifying the delivered bills; and a circulating path that guides the delivered bills to the reception port in the bill storage.

The method used to inspect the inventory or balance in the bill storage includes identifying in the input bill identification section whether an imitation bill created for inspection is being input; stopping the inputting operation after the imitation bill has been stored in the bill storage; clearing inspection counters for the respective bill types; sequentially delivering the bills stored in the bill storage and starting a circulating operation for returning the bills to the bill storage via the circulating path; identifying in the output-bill identification section the bills delivered from the bill storage and adding the number in the inspection counter for the corresponding bill type; stopping the circulating operation in response to the identification of the delivery of the imitation bill by the output-bill identification section; and discharging the imitation bill from the bill processing machine.

According to this inspection method in the bill processing machine, when the imitation bill that can be identified by the input-bill identification section in addition to normal bill types is identified and loaded on the bills stored in the bill storage, inspection of the bills stored in the bill storage is started in response to the input of the imitation bill. First, the input operation is stopped and the inspection counters for the respective bill types are cleared to zero. Subsequently, the circulating path is used to circulate the bills in the bill storage. Then, the bills delivered from the bill storage are identified, and the inspection counters for the corresponding bill types are added by its number accordingly. In this manner, once all the bills stored in the bill storage have been delivered or circulated and the imitation bill has subsequently been identified, each inspection counter for the corresponding bill type shows the number of bills actually stored in the bill storage, enabling the balance to be confirmed. The imitation bill is then discharged to the exterior.

DETAILED DESCRIPTION OF PREFERRED EMBODIMENT

An embodiment of this invention is described below in detail with reference to the drawings.

Figure 1:
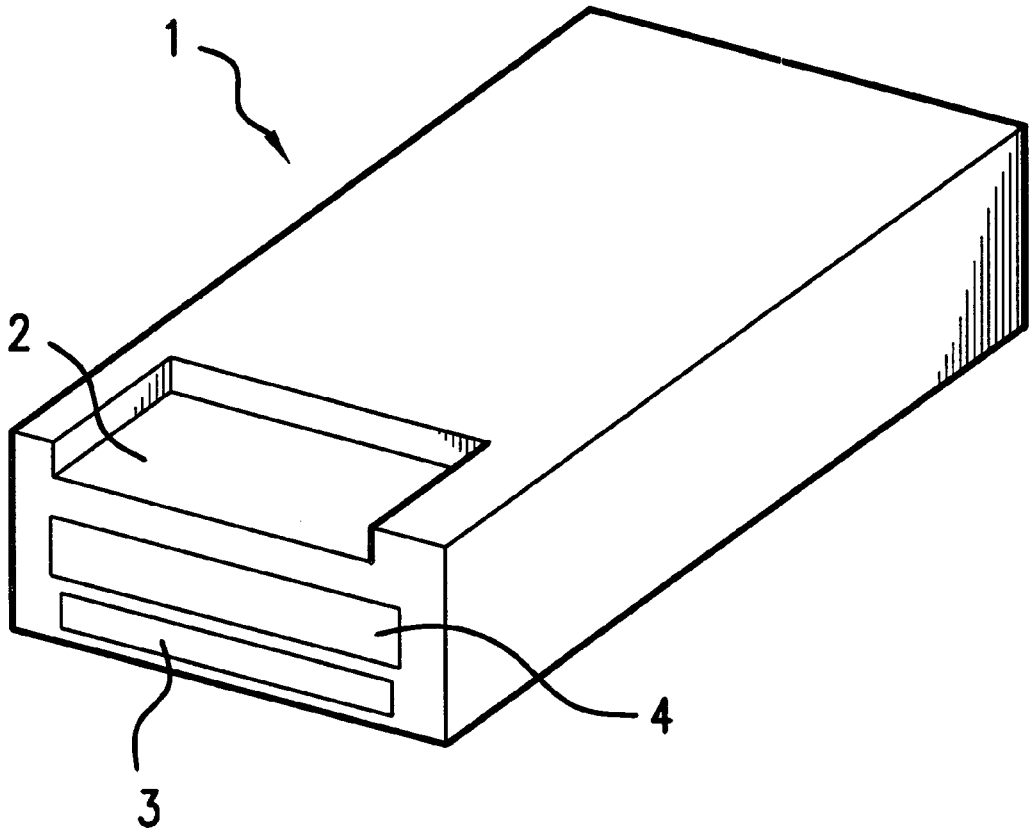
FIG. 1 is a perspective view of a bill processing machine of the invention.
Figure 2:
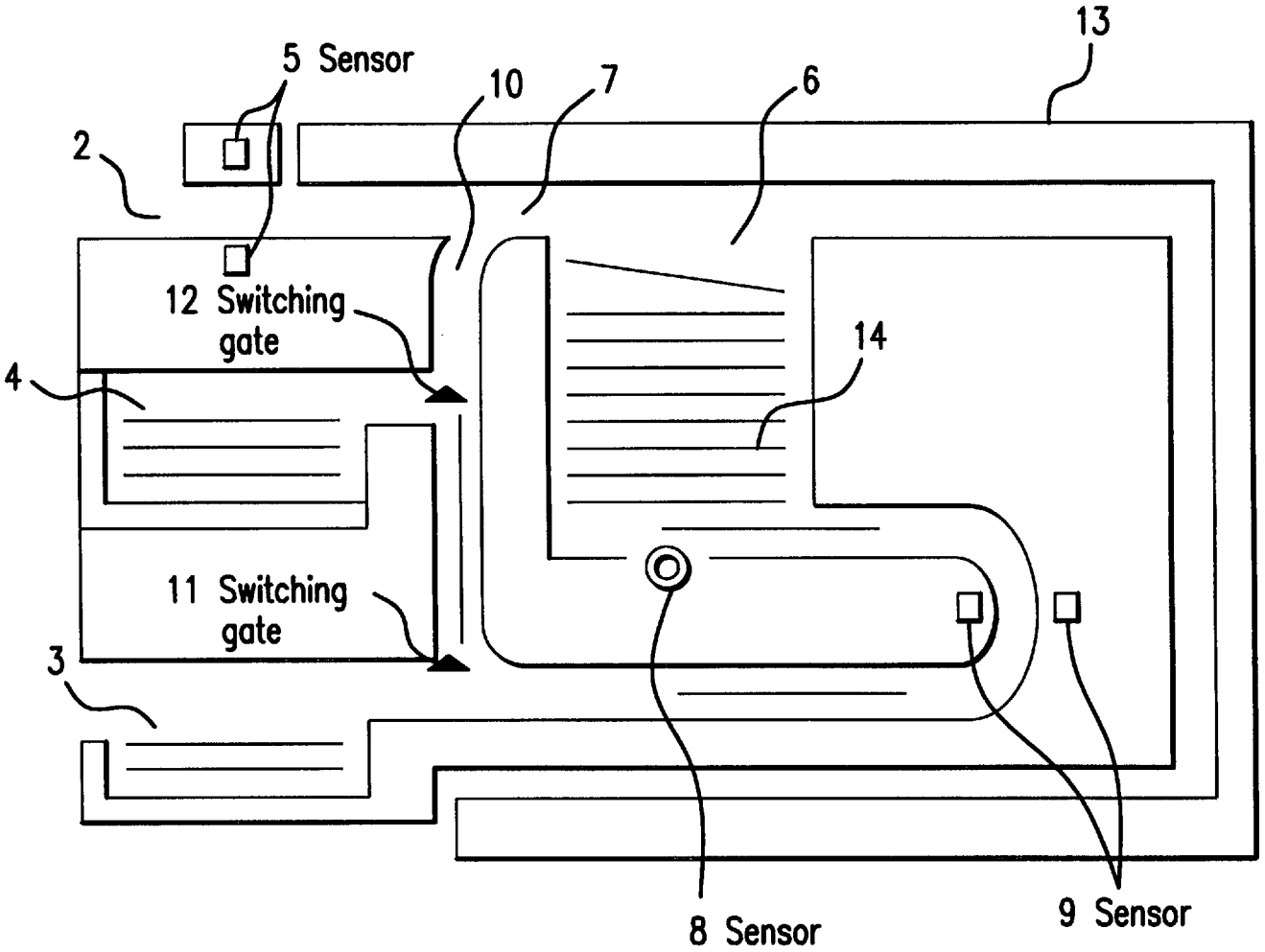
FIG. 2 is a side sectional view showing an internal structure of the bill processing machine.

FIG. 1 shows the appearance of a bill processing machine, and FIG. 2 is a side sectional view showing an internal configuration of the bill processing machine. In these figures, a bill processing machine 1 externally has an input port 2 through which bills are input; an output port 3 through which bills are paid from the bill processing machine 1 as a change; and a bill collection storage 4 in which large denomination bills not used as a change are stored.

An input-bill identification sensor 5 is provided near the bill input port 2, and a bill reception port 7 for a bill storage 6 is disposed at a downstream side of the sensor 5. A delivery section 8 through which loaded and stored bills are separated and delivered is provided at the bottom of the bill storage 6. An output-bill identification sensor 9 is provided on the downstream side of a delivery port of the bill storage 6, from which bills are delivered. The delivery port of the bill storage 6 is connected to the output port 3 and a circulating passage 10 extending in the vertical direction. A switching gate 11 that switches a bill transfer passage is provided at the lower end of the circulating passage 10, and its upper end is connected to the bill reception port 7. A switching gate 12 that switches the transfer passage to the bill collection storage 4 is provided in the middle of the circulating passage 10. The output port 3, bill collection storage 4, bill storage 6 and circulating passage 10 integrally constitute an internal unit housed in an enclosure 13 to be withdrawn. Imitation bill 14 is stored in the bill storage 6, indicating that the bill processing machine 1 in FIG. 2 is conducting an inspection.

The operation of the bill processing machine 1 during a normal trade or operation is now explained. First, when bill is input through the input port 2, a bill detection sensor (not shown) detects the input of the bill to drive an input-bill transfer motor (not shown). The bill is guided to the input-bill identification sensor 5, which then identifies the type of the bill and determines whether it is genuine. The bill that can not be determined by the input-bill identification sensor 5 to be genuine is returned to the input port 2. The bill that has been determined to be genuine is guided to the bill storage 6, in which the bill is loaded and stored through the bill reception port 7 provided in the upper part of the storage.

When a change payment command is issued from a higher control apparatus (not shown) or a delivery operation is performed by using an operation and display section (not shown), the stored bills are sequentially delivered from the bottom through the delivery section 8, and the output-bill identification sensor 9 identifies the types of the bills. If the bills are to be output, the switching gate 11 is switched to the output port side to guide the bills to the output port 3. Otherwise, the switching gate 11 is switched to the circulating passage side to pass the bills through the circulating passage 10 to the bill storage 6, in which the bills are loaded and stored. If the delivered bill is a large denomination bill not used as a change, the switching gate 12 is switched to the bill collection storage side to store the bill in the bill collection storage 4.

In addition, if the reserved bills for changes are directly and manually set in the bill storage 6 of the bill processing machine 1, the internal unit is withdrawn from the enclosure 13 and bills used as the reserved money are directly inserted into the bill storage 6 with its top opened. Once the reserved bills for changes have been set, the internal unit is housed back in the enclosure 13.

The configuration of a control section of the bill processing machine 1 is now explained.

Figure 3:
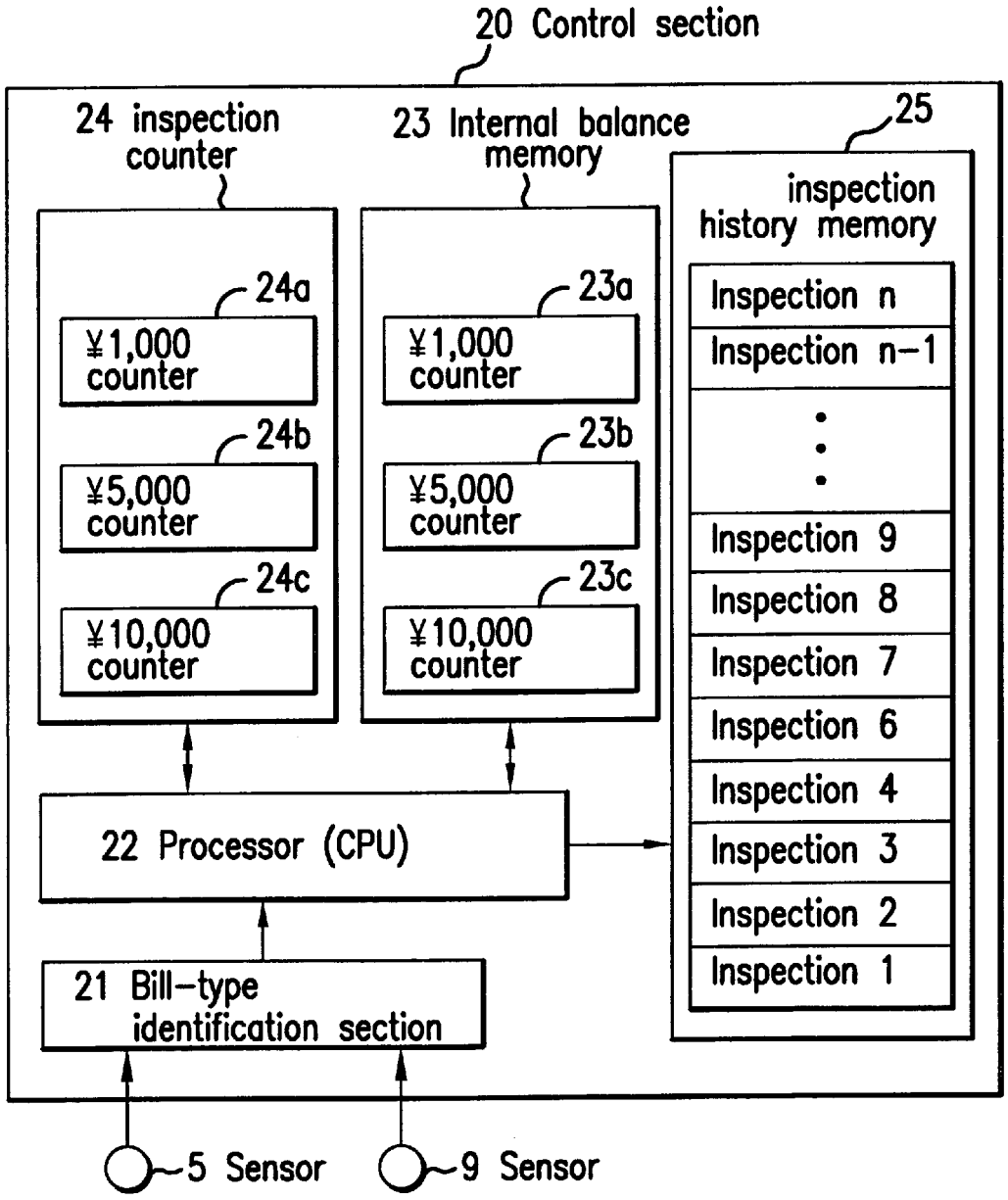
FIG. 3 is a block diagram showing an example of a structure of a control section of the bill processing machine.

FIG. 3 is a block diagram showing an example of a configuration of the control section of the bill processing machine. A control section 20 of the bill processing machine 1 comprises a bill type identification section 21 connected to the input-bill identification sensor 5 and output-bill identification sensor 9; a processor (CPU) 22; an internal balance memory 23; an inspection counter 24; and an inspection history memory 25. The internal balance memory 23 has a number of counters corresponding to the bill types including a 1,000-yen counter 23*a,* a 5,000-yen counter 23*b,* and 10,000-yen counter 23*c*. Likewise, the inspection counter 24 has a 1,000-yen counter 24*a,* a 5,000-yen counter 24*b,* and 10,000-yen counter 24*c* in order to count the bills for each bill type during the inspection.

The bill type identification section 21 has a function for identifying not only the three circulating bill types but also the imitation bill 14. The bill type identification section 21 identifies the type of the bill detected by the input-bill identification sensor 5 during input, and sends the result of the identification to the processor 22. On receiving the result, the processor 22 transfers the result to the counter for the corresponding bill type in the internal balance memory 23 in order to increase the value or number of the counter by one. In addition, when the output-bill identification sensor 9 detects the bill delivered from the bill storage 6, the bill type identification section 21 identifies its bill type and sends the result to the processor 22. The processor 22 transfers the result to the internal balance memory 23 in order to decrease the value or number of the counter for the corresponding bill type by one.

Thus, the number of bills input and output through the input and output ports 2 and 3, respectively, is managed by the internal balance memory 23. If, however, reserved bills for changes are directly and manually refilled in the bill storage 6, the internal balance memory 23 does not execute counting, and the number of bills on the internal balance memory becomes unequal to the number of bills actually stored. The inspection counter 24 and the inspection history memory 25 are used to precisely inspect the balance of the stored bills. The inspection counter 24 counts the balance for each bill type, and the result of the counting by the inspection counter 24 is added to the inspection history memory 25.

Although not shown, the control section 20 can drive the input-bill transfer motor, activate and stop the delivery section 8, and control the switching gates 11 and 12 in response to the bill detection sensor.

The input-money processing carried out by the bill processing machine 1 is now described.

Figure 4:
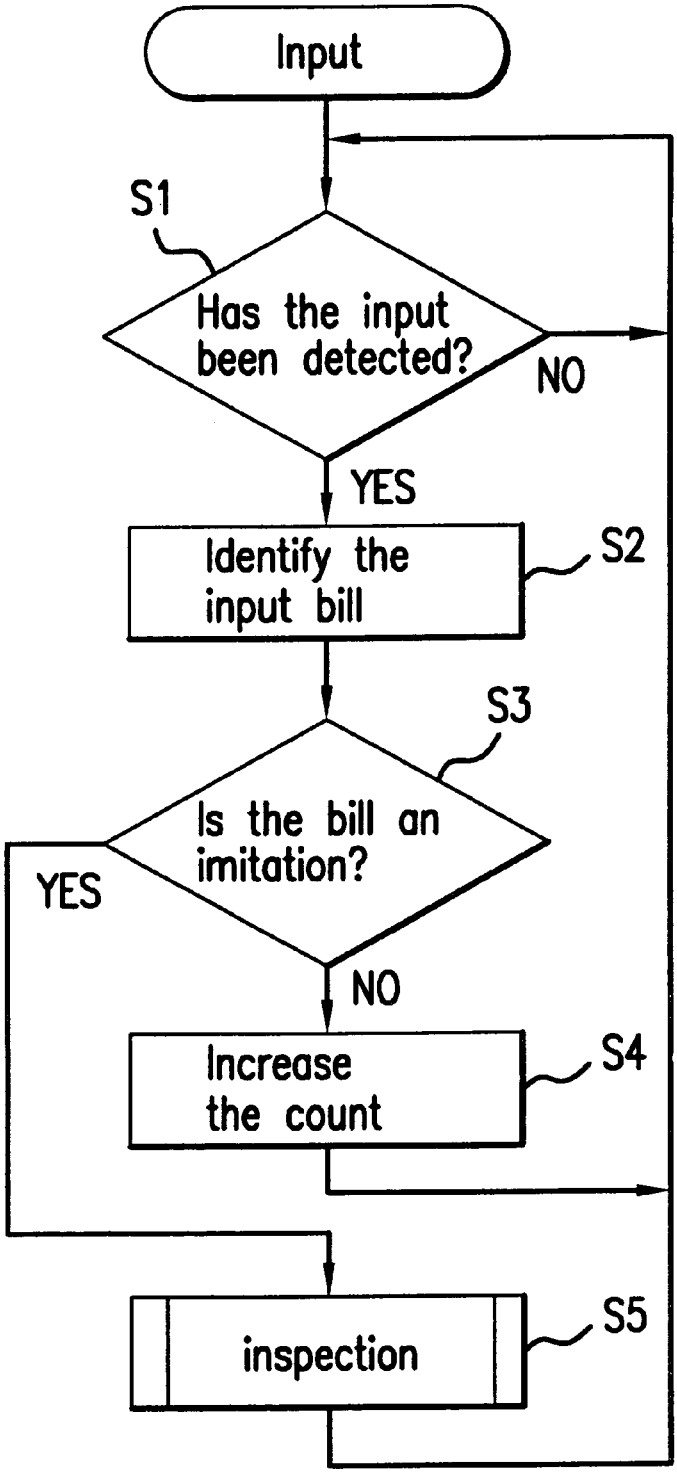
FIG. 4 is a flow chart showing a procedure for processing input-bill by the bill processing machine.

FIG. 4 is a flow chart showing a process of an input-bill by the bill processing machine. It is first determined whether the bill detection sensor provided at the input port 2 has detected the input of bill (step S1). If not, the bill detection sensor awaits until the input is detected. If the sensor detects the input, the control section 20 drives the input-bill transfer motor to guide the bill to the input-bill identification sensor 5, and the input-bill identification sensor 5 and the bill type identification section 21 of the control section 20 identify the type of the input bill (step S2) and determine whether it is an imitation bill 14 (step S3). If the input bill is one of the three circulating bill types, the control section 20 increases the value or number of the counter for the corresponding bill type in the internal balance memory 23 by one (step S4). If the input bill is determined to be an imitation bill 14, the bill processing machine 1 starts inspection processing (step S5).

Figure 5:
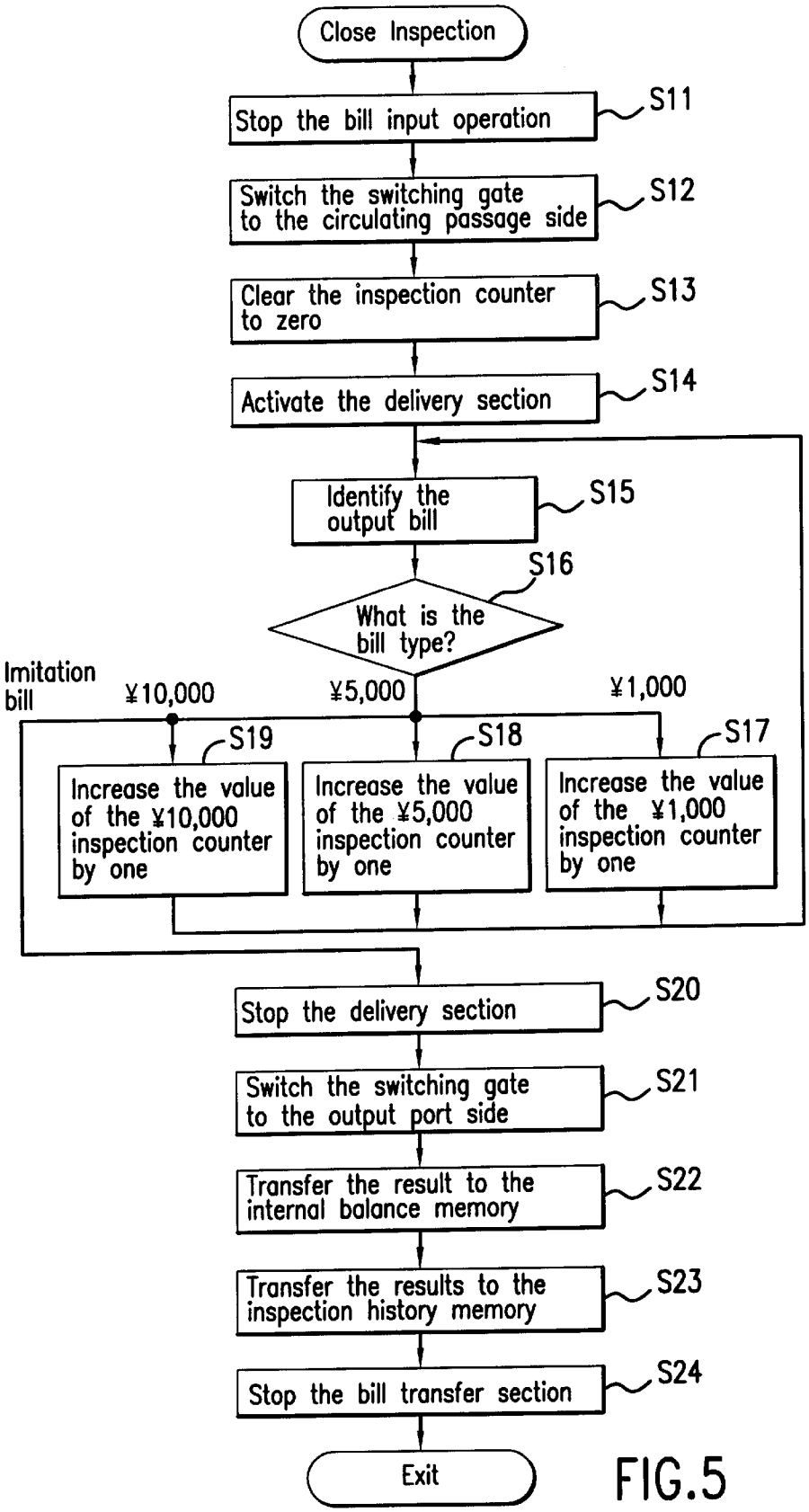
FIG. 5 is a flow chart showing a procedure of inspection by the bill processing machine.

FIG. 5 is a flow chart showing a flow of the inspection processing by the bill processing machine. When the bill-type identification section 21 determines that the input bill is an imitation bill 14 specially created for the inspection, the control section 20 immediately stops the bill input operation (step S11). The control section 20 subsequently switches the switching gates 11 and 12 to the circulating passage 10 side (step S12). Then, the control section 20 clears the counters for the respective bill types in the inspection counter 24 to zero (step S13).

The control section 20 then activates the delivery section 8 to start delivering the stored bills (step S14). The delivered bills reach the output-bill identification sensor 9, in which the bill type identification section 21 identifies the output bill (step S15). Then, based on the identified bill type, the processing is separated (step S16). If the identified bill type is a 1,000-yen bill, the value of the 1,000-yen counter 24*a* of the inspection counter 24 is increased by one (step S17); or if the bill type is a 5,000-yen bill, the value of the 5,000-yen counter 24*b* of the inspection counter 24 is increased by one (step S18); or if the bill type is a 10,000-yen bill, the value of the 10,000-yen counter 24*c* of the inspection counter 24 is increased by one (step S19). After the increase in the inspection counter 24, the process returns to step S15 to identify the next delivered bill.

If step S15 determines that the bill type is the imitation bill 14, the bill delivery operation at the delivery section 8 is stopped (step S20). At this point, the inspection counter 24 shows the number of bills for each bill type. Subsequently, the control section 20 switches the switching gate 11 to the output port 3 side to discharge the imitation bill 14 from the bill processing machine 1 (step S21). The control section 20 transfers to the internal balance memory 23 the result of the calculation by the inspection counter 24 (step S22). Likewise, the result of the calculation by the inspection counter 24 is transferred to the inspection history memory 25 (step S23).

In this case, the transfer to the inspection history memory 25 is not executed by overwriting data but by providing a pointer (not shown) and sequentially storing the result in the region of the memory located next to the previously stored data. The control section 20 transfers the imitation bill 14 to the output port 3, and stops the bill transfer section (step S24). Thus, even if reserved bills for changes are refilled in the bill storage 6 during the operation of the bill processing machine 1 to thereby cause the contents of the internal balance memory 23 different from the number of bills actually stored, this inspection forcibly modifies the memory to the number of the bills counted at that time, thereby enabling the balance to be properly counted and managed.

Figure 6:
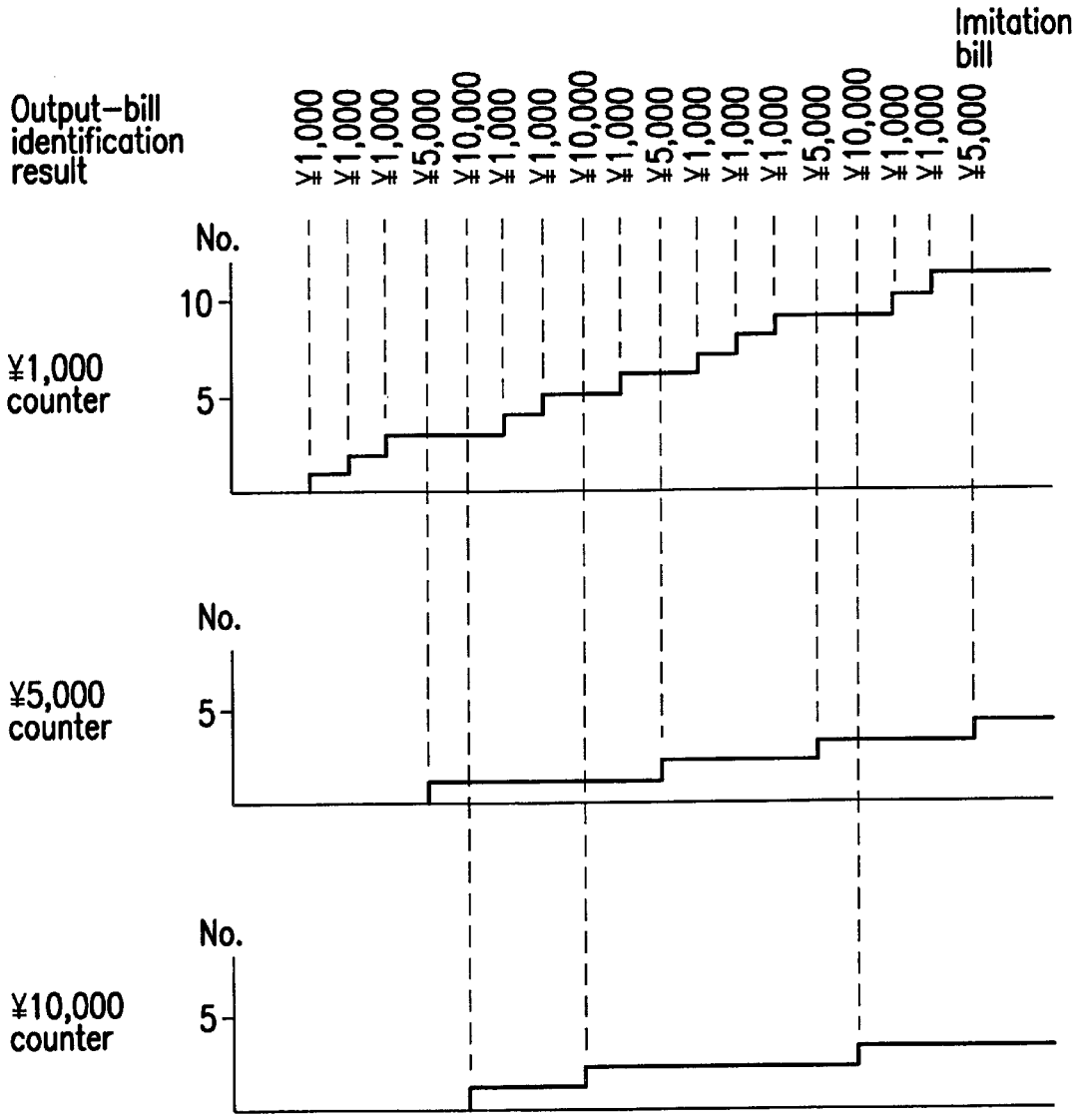
FIG. 6 shows an example of counting by an inspection counter.
Figure 2:
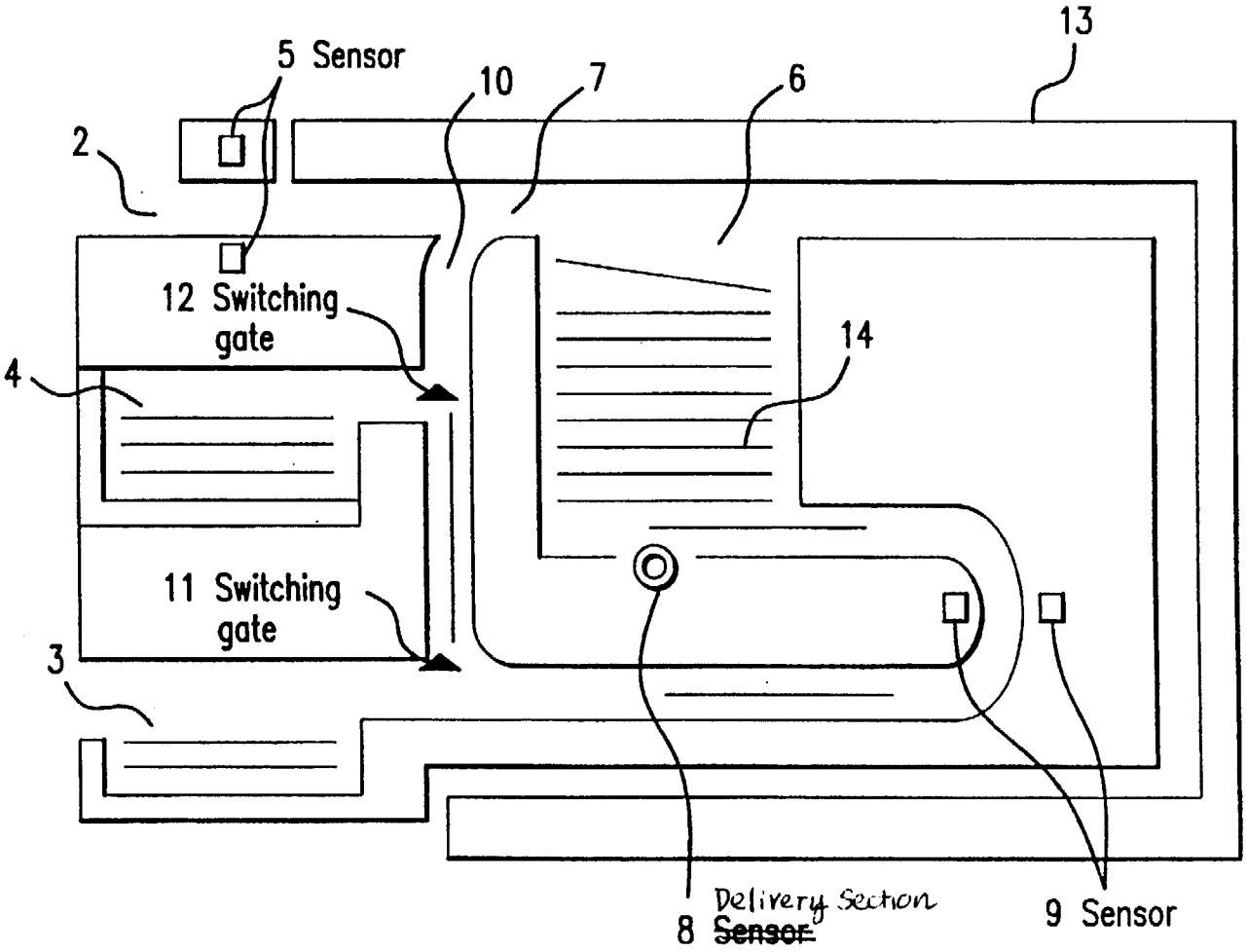

FIG. 6 shows an example of counting by the inspection counter. In this example, the bills stored in the bill storage 6 when the imitation bill 14 is input are assumed to be loaded in the order of the bill types shown as a result of output bill identification. Thus, the first bill to be delivered from the bottom of the bill storage 6 is 1,000 yen and the imitation bill 14 is placed at the top. When an inspection is started, each counter of the inspection counter 24 has been reset to zero, so that the contents of the 1,000-yen counter 24*a,* 5,000-yen counter 24*b,* and 10,000-yen counter 24*c* have been cleared.

When the first 1,000 yen is delivered, the value or number of the 1,000-yen counter 24*a* is increased by one. Likewise, if the delivered bill is 5,000 yen, the value of the 5,000-yen counter 24*b* is increased by one. If the delivered bill is 10,000 yen, the value of the 10,000-yen counter 24*c* is increased by one. In this manner, the value or number of the counter for the corresponding bill type is increased by one depending on the result of identification for the output bill until the imitation bill 14 is identified. The value of each counter of the inspection counter 24 when the imitation bill 14 is identified shows the number of bills stored for each bill type, and in the illustrated example, there remain eleven 1,000-yen bills, four 5,000-yen bills, and three 10,000-yen bills after the inspection. The result of the inspection is transferred to the internal balance memory 23 and inspection history memory 25.

As described above, this invention is designed to start the inspection by input and identification of the imitation bill. This configuration enables the inspection starting point (a pointer) to be set without the need for mechanical means to prevent costs from increasing.

In addition, the inspection function enables the balance of the stored bills to be constantly determined despite the change refilling operations, thereby enabling cash to be accurately managed.

In terms of cash management, the history of the inspection can be stored whenever reserved bills for changes are refilled or the operator is changed, so it is easy to determine when errors occurred. Furthermore, the inspection function is expected to prohibit the operator from committing crimes.

What is claimed is:

1. A method for inspecting a balance in a bill processing machine, comprising:

identifying in an input bill identification section of a bill processing machine whether an imitation bill created for inspection is being input;

clearing inspection counters for bill types when the imitation bill is detected;

sequentially delivering bills loaded and stored in a bill storage to start a circulating operation of the bills and returning the bills to the bill storage via a circulating path in the bill processing machine;

identifying the bills delivered from the bill storage at an output-bill identification section of the bill processing machine and counting a number of bills according to the bill types at inspection counters;

stopping said circulating operation when the imitation bill is identified by the output-bill identification section; and discharging the imitation bill from the bill processing machine.

2. A method for inspecting a balance according to claim 1, wherein in case the imitation bill is identified in the input bill identification section, an inputting operation of a new bill is stopped after the imitation bill has been transferred to the bill storage.

3. A method for inspecting a balance according to claim 1, wherein after the output-bill identification section has identified the imitation bill, a result of counting by the inspection counter is transferred to a balance memory for the bill types in the bill processing machine.

4. A method for inspecting a balance according to claim 1, wherein after the output-bill identification section has identified the imitation bill, a result of counting by the inspection counter is transferred to an inspection history memory in the bill processing machine.

5. A method for inspecting a balance according to claim 1, wherein the bill storage is located at a downstream side of the input-bill identification section, said bill storage, in a normal usage, receiving identified bills at the input-bill identification section and storing the bills therein, and delivering the stored bills therefrom when there is a command.

* * * * *

UNITED STATES PATENT AND TRADEMARK OFFICE

CERTIFICATE OF CORRECTION

PATENT NO. : 6,050,386 page 1 of 2

DATED : April 18, 2000

INVENTOR(S) : Nobuyuki Niizuma

It is certified that error appears in the above-indentified patent and that said Letters Patent is hereby corrected as shown below:

In the drawing on the cover page, please change "Sensor" designated by numeral 8 to --Delivery section--, as shown in red in the attached copy thereof;

In Fig. 2, change "Sensor" designated by numeral 8 to --Delivery section--, as shown in red in the attached copy thereof; and In column 1, line 28, change "machines" to --machine--.

Signed and Sealed this

Tenth Day of April, 2001

*Attest:*

Nicholas P. Godici

NICHOLAS P. GODICI

*Attesting Officer*

*Acting Director of the United States Patent and Trademark Office*